United States Patent [19]

Steck et al.

[11] 4,344,791

[45] Aug. 17, 1982

[54] MANUFACTURE OF ACICULAR FERROMAGNETIC IRON PARTICLES

[75] Inventors: Werner Steck, Mutterstadt; Wilhelm Sarnecki, Limburgerhof; Laszlo Marosi, Ludwigshafen; Manfred Ohlinger, Frankenthal; Werner Loeser, Ludwigshafen, all of Fed. Rep. of Germany

[73] Assignee: BASF Aktiengesellschaft, Fed. Rep. of Germany

[21] Appl. No.: 174,267

[22] Filed: Jul. 31, 1980

[30] Foreign Application Priority Data

Sep. 1, 1979 [DE] Fed. Rep. of Germany ..... 2935358

[51] Int. Cl.[3] ..... C22B 5/12; C22C 1/04

[52] U.S. Cl. ..... 75/0.5 AA; 148/105; 252/62.55; 427/127; 427/216

[58] Field of Search ..... 252/62.55; 75/0.5 AA, 75/0.5 BA; 148/105; 427/127, 216

[56] References Cited

U.S. PATENT DOCUMENTS

| | | | |
|---|---|---|---|
| 3,607,220 | 9/1971 | Van der Giessen et al. | 75/0.5 AA |
| 3,627,509 | 12/1971 | Van der Giessen et al. | 75/0.5 AA |
| 4,017,303 | 4/1977 | Koester et al. | 75/0.5 AA |
| 4,050,962 | 9/1977 | Koester et al. | 148/105 |
| 4,061,725 | 12/1977 | Ohlinger et al. | 423/634 |
| 4,061,726 | 12/1977 | Ohlinger et al. | 423/634 |
| 4,061,727 | 12/1977 | Vaeth et al. | 423/634 |
| 4,155,748 | 5/1979 | Steck et al. | 75/0.5 AA |
| 4,178,171 | 12/1979 | Steck et al. | 75/0.5 AA |

FOREIGN PATENT DOCUMENTS

| | | | |
|---|---|---|---|
| 1204644 | 11/1965 | Fed. Rep. of Germany . | |
| 54-122699 | 9/1979 | Japan | 423/633 |

*Primary Examiner*—Jack Cooper

*Attorney, Agent, or Firm*—Keil & Witherspoon

[57] ABSTRACT

A process for the manufacture of acicular ferromagnetic iron particles by heating a goethite, provided with a shape-stabilizing surface coating, at 250°–450° C. in an atmosphere containing water vapor at a partial pressure of not less than 30 mbar, to give alpha-iron(III) oxide, and reducing this material with hydrogen at 275°–425° C., and the use of the iron particles thus obtained as magnetic material in the production of magnetic recording media.

2 Claims, No Drawings

MANUFACTURE OF ACICULAR FERROMAGNETIC IRON PARTICLES

The present invention relates to a process for the manufacture of acicular ferromagnetic iron particles by heating a goethite, provided with a shape-stabilizing surface coating, to give alpha-iron(III) oxide, and reducing this material with hydrogen at 275°-425° C.

Because of their high saturation magnetization and the high coercive force achievable, ferromagnetic metal powders and thin metal layers are of particular interest for the manufacture of magnetic recording media. This is due to the fact that they permit a substantial increase in the energy product and the information density, so that narrower signal widths and higher signal amplitudes can be achieved with such recording media.

It is true that, when acicular ferromagnetic metal powders are used as magnetizable materials in the manufacture of magnetic recording media, the mechanical properties of such media can, in contrast to the use of homogeneous thin metal layers, be varied within wide limits by appropriate choice of the polymeric organic binder system, but in that case high demands are made not only on the magnetic properties but also on their shape, size and dispersibility.

Since a high coercive force and a high residual induction are essential prerequisites for magnetic pigments intended for magnetic coatings serving as data storage memories, the metal particles employed must exhibit single-domain behavior and furthermore the existing anisotropy of the particles or the anisotropy additionally achievable in the tape by orientation of the magnetic particles should only be slightly affected by external factors, for example elevated temperatures or mechanical stresses, i.e. the small particles should exhibit shape anisotropy and preferably be acicular, and should in general have a size of from $10^2$ to $10^4$ A.

It is known that iron particles of the type described can be produced by reducing finely divided acicular iron compounds, e.g. the oxides, with hydrogen or with some other gaseous reducing agent. The reduction must be carried out at above 300° C. if it is to take place at an industrially acceptable speed. However, this is attended by the problem of sintering of the resulting metal particles. As a result, the particle shape no longer conforms to that required to give the desired magnetic properties.

In order to lower the reduction temperature, it has already been proposed, in German Laid-Open Application DOS No. 2,014,500, to catalyze the reduction by applying silver or a silver compound to the surface of finely divided iron oxide. The treatment of the iron oxide with tin(II) chloride has also been described (German Laid-Open Application DOS No. 1,907,691).

However, the catalytic acceleration of the reduction of preferably acicular starting compounds in general gives needles which are far smaller than those of the starting material, and furthermore the length-to-width ratio is low. As a result, the end product exhibits a rather broad particle size spectrum. On the other hand, it is known that the dependence of the coercive force and residual induction of magnetic materials on their particle size is very great when the particles are of a size of the order of magnitude of single-domain particles. If to this are added the effects resulting from the presence of a proportion of superparamagnetic particles, which may be formed as fragments in the above process, such magnetic materials are unsuitable for use in the manufacture of magnetic recording media. With such heterogeneous mixtures the magnetic field strength required to reverse the magnetization of the particles varies greatly, and the distribution of the residual magnetization as a function of the applied external field also gives a less steep residual induction curve.

Attempts to provide the iron oxides, which are to be reduced, with a surface coating in order to prevent sintering of the individual particles at the required reduction temperature, such attempts being described, for example, in German Laid-Open Applications DOS No. 2,434,058, DOS No. 2,434,096, DOS No. 2,646,348 and DOS No. 2,714,588, have also not proved entirely satisfactory.

It is an object of the present invention to provide a process for the manufacture of acicular ferromagnetic iron particles, by means of which particles which have pronounced shape anisotropy and a high coercive force and, in particular, high remanence and relative remanence, can be produced in a simple manner.

We have found that this object is achieved and that acicular ferromagnetic iron particles having the required properties may be produced by reacting an aqueous solution of an iron(II) salt with an aqueous solution of an alkali metal hydroxide, oxidizing the resulting suspension of iron(II) hydroxide with an oxygen-containing gas to give goethite, applying a shape-stabilizing coating to the surface of the goethite, heating the so-treated goethite to give alpha-iron(III) oxide and then reducing the latter with hydrogen at 275°-425° C. to give acicular ferromagnetic iron particles, if the goethite provided with a shape-stabilizing coating is heated at 250°-450° C. in an atmosphere containing water vapor at a partial pressure of not less than 30 mbar for from 10 minutes to 10 hours.

It is particularly advantageous to heat the goethite, provided with a shape-stabilizing coating, for from 10 minutes to 10 hours at 250°-450° C. in an atmosphere containing water vapor at a partial pressure (S.T.P.) of from 30 to 1013 mbar.

The production of this goethite, employed in the novel process, by the alkaline method is known and is described in detail in, for example, German Published Application DAS Nos. 1,204,644, 2,550,225, 2,550,307 and 2,550,308. These goethite needles are characterized by a specific surface area, determined by the BET method, of from 20 to 75 $m^2/g$, a mean particle length of from 0.2 to 1.5 $\mu m$ and preferably from 0.3 to 1.2 $\mu m$ and a length/width ratio of not less than 10:1, advantageously from 10 to 40:1.

The goethite particles required for the novel process are then provided, in a conventional manner, with a surface coating which assists in maintaining the external shape of the particles during the further processing steps. A suitable method is to treat the goethite with an alkaline earth metal cation and a carboxylic acid or some other organic compound which possesses two or more groups capable of chelating the alkaline earth metal cation. These processes are described in German Laid-Open Application DOS Nos. 2,434,058 (U.S. Pat. No. 4,017,303) and 2,434,096. (U.S. Pat. No. 4,050,962).

Another conventional method, described in German Laid-Open Application DOS No. 2,646,348, (which corresponds to U.S. Pat. No. 4,155,748) is to stabilize the shape of the goethite particles by surface treatment with a mixture of (a) hydrolysis-resistant oxyacids of phosphorus, or their salts or esters and (b) aliphatic monobasic or polybasic carboxylic acids. Examples of suitable hydrolysis-resistant compounds are phosphoric acid, soluble monophosphates, diphosphates and triphosphates, eg. potassium dihydrogen phosphate, ammonium dihydrogen phosphate, disodium orthophosphate, dilithium orthophosphate and trisodium phosphate, as well as sodium pyrophosphate and metaphosphates, eg. sodium metaphosphate. The compounds may be employed individually or as mixtures with one another. Esters of phosphoric acid with aliphatic monoalcohols of 1 to 6 carbon atoms, for example tert.-butyl esters of phosphoric acid, can also be employed with advantage. Suitable carboxylic acids include saturated and unsaturated aliphatic carboxylic acids which contain up to 6 carbon atoms and up to 3 acid groups and in which one or more hydrogen atoms of the aliphatic chain may be substituted by hydroxyl or amino. Hydroxydicarboxylic acids and hydroxytricarboxylic acids, eg. tartaric acid and citric acid, as well as oxalic acid are particularly suitable.

The goethite which has been provided with a shape-stabilizing coating as described is then heated, according to the novel process, for from 10 minutes to 10 hours at 250°–450° C. in an atmosphere containing water vapor at a partial pressure of not less than 30 mbar. The end product is an acicular alpha-iron(III) oxide possessing a surface coating formed in accordance with the preceding surface treatment.

This heating step may be carried out batchwise or continuously. For batchwise dehydration, reactors such as muffle furnaces, rotary kilns or fluidized bed furnaces may be used. To achieve better mixing, air, an inert gas or a mixture of air and an inert gas may be passed over or through the static or agitated iron oxide, the gas first being laden with the appropriate amount of water vapor. Advantageously, the gas or gas mixture is saturated with water vapor at from 40° C. to the boiling point of water, especially from 50° C. to the boiling point of water, and is passed into the reactor in this saturated form. The water can of course also be introduced direct in the form of steam, or be admixed in the form of steam to the other gases. Heating may be carried out particularly advantageously in continuous reactors, for example a continuous rotary kiln, since here, in addition to the water vapor in the gas passed through the furnace, water vapor is also supplied continuously, in constant amount, from the goethite dehydration reaction. Hence, this continuous treatment can also be carried out without a stream of inert gas or of air, or with only a slight stream of inert gas or of air. After a brief period for reaching steady-state conditions, the required water vapor partial pressure, preferably of 70–1013 mbar, is reached in the reaction chamber.

To produce the acicular ferromagnetic iron particles, the alpha-iron(III) oxide carrying a shape-stabilizing surface coating is reduced in a conventional manner with hydrogen at from 275° to 425° C., preferably from 300° to 400° C. It is advantageous to passivate the resulting finely divided iron powder by passing a mixture of air and inert gas, or oxygen and inert gas, over the material, since the pyrophoric character of the acicular iron particles, having a length of from 0.1 to 0.8 μm and a length-to-width ratio of from 5:1 to 25:1, can thereby be kept under control.

Using the novel process, it is possible to produce acicular ferromagnetic iron particles which exhibit excellent shape anisotropy. This is achieved because the starting materials are substantially dendrite-free and have been treated to retain their external shape, and since the heating according to the invention gives an iron(III) oxide, having a uniform crystal structure, for the subsequent reduction reaction. Consequently, the resulting iron particles are distinguished by a substantially improved coercive force, specific remanence and relative remanence.

If the iron particles obtained according to the invention are used in a conventional manner for the production of magnetic recording media, the acicular particles can be magnetically oriented especially easily, and furthermore the important electro-acoustic properties, such as maximum output level at short and long wavelengths, are improved.

To produce magnetic dispersions, the iron particles produced according to the invention are dispersed in a conventional manner in polymeric binders. Suitable binders for this purpose are conventional compounds such as homopolymers and copolymers of vinyl monomers, polyurethanes, polyesters and the like. The binders are used in solution in suitable organic solvents, which may contain further additives, for example to increase the conductivity and abrasion resistance of the magnetic layers. A homogeneous dispersion is obtained by milling the magnetic pigment, the binder and any additives; this dispersion is applied to rigid or flexible bases such as films, discs or cards, the magnetic particles contained in the dispersion are oriented by means of a magnetic field, and the layer is solidified by drying.

The Examples which follow illustrate the process according to the invention and, together with the Comparative Experiments, demonstrate the advance in the art that has been achieved.

The acicular iron(III) oxide hydroxides employed were primarily characterized by the surface area $SN_2$ determined by the BET method, using nitrogen. Electron micrographs provided information on the appearance and dimensions (length-to-width ratio) of the iron oxide hydroxide particles.

The magnetic properties of the iron powder were measured by means of a vibrating sample magnetometer at a field strength of 160 or 800 kA/m. The coercive force, $H_c$, measured in kA/m, was based on a tap density $\rho$ of 1.6 g/cm$^3$. The specific remanence ($M_{r/\rho}$) and specific saturation magnetization ($M_{m/\rho}$) are each given in nTm$^3$/g.

In addition to a high coercive force $H_c$ and a high residual induction, the remanence coercivity $H_R$ is an important parameter for assessing the product. In d.c. demagnetization, half (by volume) of the particles are reverse-magnetized at a field strength which is equivalent to the remanence coercivity $H_R$. Accordingly, $H_R$ is a characteristic parameter for recording processes which, in particular, determines the bias setting for magnetic recording. The more non-uniform the remanence coercivity of the individual magnetic particles in the recording layer, the broader is the distribution of the magnetic fields which are able to reverse the magnetization of a defined volume of the recording layer. This is particularly noticeable if, because of high recording densities or short wavelengths, the boundary zone between zones of opposite magnetization is narrow. To characterize the distribution of the field strengths of the individual particles, a value $h_5$ for the total width of the remanence curve and a value $h_{25}$ for the slope of the remanence curve are determined from the d.c. demagnetization curve. The values are determined using the equations $h_5 = H_{95} - H_5)/H_R$ and $h_{25} = (H_{75} - H_{25})/H_R$.

The subscript following the letter H indicates what percentage of the particles has in each case been reverse-magnetized.

EXAMPLE 1

500 parts of a goethite produced as described in German Published Application DAS No. 1,204,644 are suspended in a 16-fold amount of water by stirring vigorously for 3 hours. 5 parts of phosphoric acid and 5 parts of oxalic acid ($H_2C_2O_4.2H_2O$) dissolved in 45 parts of water are then added. After stirring for a further seven hours, the solid is filtered off and dried in air at 170° C. The goethite treated in this way contains 0.9% by weight of phosphate and 0.08% by weight of carbon, and has a surface area ($S_{N2}$) of 36.9 $m^2/g$.

70 parts of this product are then heated for one hour at 350° C. in a rotary kiln whilst a mixture of air and water vapor, having a water vapor partial pressure ($pH_2O$) of 840 mbar, is passed over the material. The resulting surface-treated alpha-iron(III) oxide, having a surface area $S_{N2}$ of 64.2 $m^2/h$, is then reduced to acicular iron by treatment with hydrogen at 350° C. in a rotary kiln for 8 hours. The magnetic properties measured on the acicular iron particles are shown in Table 1.

COMPARATIVE EXPERIMENT 1

70 parts of a goethite which has been surface-treated as described in Example 1 are also heated in a rotary kiln for one hour at 350° C., but under a pressure of 25 mbar.

This reduced pressure in the reaction chamber is produced by a vacuum pump and is kept constant by bleeding in air, dried over silica gel, via a vacuum valve. The resulting surface-treated alpha-iron(III) oxide having a surface area $S_{N2}$ of 50 $m^2/g$ is then reduced to the metal in the same manner as described in Example 1. The magnetic properties measured on the acicular iron particles are shown in Table 1.

EXAMPLE 2

70 parts of a goethite which has been surface-treated as described in Example 1 are heated for one hour at 350° C. and a $pH_2O$ of 762 mbar, and the resulting product is then reduced to acicular iron with hydrogen (in a 63-fold excess) at 350° C. in a fluidized bed furnace for 6 hours. Finally, the pyrophoric iron particles are passivated by passing a mixture of air and nitrogen (containing 1% by volume of oxygen) over the material at below 50° C. The magnetic properties of the pyrophoric and passivated sample are shown in Table 1. In addition, the magnetic properties of the passivated sample were measured at a field strength of 800 kA/m. The results obtained are shown in Table 2.

COMPARATIVE EXPERIMENT 2

The procedure followed is as described in Example 2, except that the surface-treated goethite is reduced as in Example 2 without having received an additional treatment. The magnetic properties of the resulting pyrophoric and passivated iron particles are shown in Tables 1 and 2.

COMPARATIVE EXPERIMENT 3

500 parts of a goethite which has been produced as described in German Published Application DAS No. 1,204,644 and has a surface area $S_{N2}$ of 39 $m^2/g$ are heated for one hour in a rotary kiln at 350° C. under a pressure of 25 mbar. This reduced pressure in the reaction chamber is produced by a vacuum pump and is kept constant by bleeding in air, dried over silica gel, via a vacuum valve. The resulting alpha-iron(III) oxide having a surface area $S_{N2}$ of 48.7 $m^2/g$ is then reduced in the same manner as described in Example 1. The magnetic properties measured on the acicular iron particles are shown in Table 1.

COMPARATIVE EXPERIMENT 4

500 parts of a goethite prepared as described in German Published Application DAS No. 1,204,644 and having a surface area $S_{N2}$ of 39 $m^2/g$ are heated for one hour at 350° C. in a rotary kiln whilst passing a mixture of air and water vapor, having a water vapor partial pressure ($pH_2O$) of 840 mbar, over the material. The resulting alpha-iron(III) oxide is then reduced in the manner described in Example 1. The magnetic properties measured on the acicular iron particles are shown in Table 1.

COMPARATIVE EXPERIMENT 5

45 parts of an alpha-iron(III) oxide produced by heating as described in Comparative Experiment 3 are suspended in 450 parts of water, with vigorous stirring. 0.35 part of 85% strength phosphoric acid and 0.5 part of oxalic acid ($H_2C_2O_4.2H_2O$), dissolved in 20 parts of water, are then added to the suspension. After stirring for a further 20 minutes, the solid is filtered off and dried in air at 170° C. The resulting surface-treated alpha-iron(III) oxide has a surface area $S_{N2}$ of 69.1 $m^2/g$, a phosphate content of 1.6% by weight and a carbon content of 0.08% by weight. The subsequent reduction is carried out as described in Example 1. Finally, the pyrophoric acicular iron particles are passivated by passing a mixture of air and nitrogen, containing 1% by volume of oxygen, over the material at below 60° C. The magnetic properties of the pyrophoric and passivated samples are shown in Table 1.

COMPARATIVE EXPERIMENT 6

45 parts of an alpha-iron(III) oxide produced by heating as described in Comparative Experiment 4 are suspended in 450 parts of water, with vigorous stirring. 0.35 part of 85% strength phosphoric acid and 0.5 part of oxalic acid ($H_2C_2O_4.2H_2O$), dissolved in 20 parts of water, are then added to the suspension. After stirring for a further 20 minutes, the solid is filtered off and dried in air at 170° C. The resulting surface-treated alpha-iron(III) oxide has a surface area $S_{N2}$ of 38.8 $m^2/g$, a phosphate content of 1.4% by weight and a carbon content of 0.07% by weight. The subsequent reduction is carried out as described in Example 1. Finally, the pyrophoric acicular iron particles are passivated by passing a mixture of air and nitrogen, containing 1% by volume of oxygen, over the material at below 60° C. The magnetic properties of the pyrophoric and passivated samples are shown in Table 1.

TABLE 1

| | $H_c(\delta = 1.6)$ | $M_r/\delta$ | $M_m/\delta$ | $M_r/M_m$ |
|---|---|---|---|---|
| Example 1 | 70.6 | 85 | 148 | 0.57 |
| Comparative Experiment 1 | 56.8 | 76 | 146 | 0.52 |
| Example 2 | 71.2 | 94 | 155 | 0.61 |
| Example 2 passivated | 73.6 | 67 | 111 | 0.60 |
| Comparative Experiment 2 | 68.3 | 84 | 144 | 0.58 |
| Comparative Experiment 2 | | | | |

TABLE 1-continued

| | $H_c(\delta = 1.6)$ | $M_r/\delta$ | $M_m/\delta$ | $M_r/M_m$ |
|---|---|---|---|---|
| passivated | 72.3 | 60 | 104 | 0.58 |
| Comparative Experiment 3 | 55 | 87 | 160 | 0.54 |
| Comparative Experiment 4 | 54 | 85 | 158 | 0.54 |
| Comparative Experiment 5 | 71.4 | 85 | 144 | 0.59 |
| Comparative Experiment 5 passivated | 74.9 | 60 | 103 | 0.58 |
| Comparative Experiment 6 | 72.0 | 93 | 154 | 0.60 |
| Comparative Experiment 6 passivated 75.4 | 67 | 113 | 0.59 | |

TABLE 2

| | $H_c(\delta = 1.6)$ | $H_R/H_c$ | $M_s$* | $h_{25}$ |
|---|---|---|---|---|
| Example 2 passivated | 102 | 1.24 | 188 | 0.61 |
| Comparative Experiment 2 passivated | 107 | 1.27 | 184 | 0.63 |

*$M_s$ = saturation magnetization

EXAMPLE 3

800 parts of passivated iron particles produced as described in Example 2 are mixed, in a tube mill having a capacity of 6000 parts by volume and containing 9,000 parts of steel balls of diameter from 4 to 6 mm, with 456 parts of a 13 percent strength solution of a thermoplastic polyester-urethane (obtained from adipic acid, butane-1,4-diol and 4,4'-diisocyanatodiphenylmethane) in a solvent mixture of equal parts of tetrahydrofuran and dioxane, 296 parts of a 10 percent strength solution of a polyvinylformal binder (containing 82 percent of vinylformal units, 12 percent of vinyl acetate units and 6 percent of vinyl alcohol units), in the said solvent mixture, 20 parts of butyl stearate and a further 492 parts of the said solvent mixture, and the batch is dispersed for 4 days. A further 456 parts of the said polyester-urethane solution, 296 parts of the polyvinylformal solution and 271 parts of the solvent mixture, and 2 parts of a commercial silicone oil, are added, and the batch is dispersed for a further 24 hours and filtered through a cellulose/asbestos fiber layer. The magnetic dispersion thus obtained is applied to an 11.5 μm thick polyethylene terephthalate base film, using a conventional coating apparatus and, after the coated base has passed through a magnetic orienting field, the coating is dried in the course of 2 minutes at 80°–100° C. The coated base is then calendered by passing it between polished rollers heated to 60°–80° C. The finished magnetic coating is 3.5 μm thick. The coated base is cut into 3.81 mm wide tapes.

The electroacoustic properties of these tapes are measured substantially in accordance with DIN 45,512, using a tape speed of 4.75 cm/sec, an HF bias current $J_{HF}$ of 23 mA and an equalization time constant of 70 μsec.

Table 3 shows the maximum output levels at 333 Hz ($A_T$) and at 10 kHz ($A_H$). The values for the magnetic tape from Comparative Experiment 7 were taken to be 0 dB.

COMPARATIVE EXPERIMENT 7

Acicular iron particles produced as described in Comparative Experiment 2 are used to produce a magnetic recording medium as described in Example 3. The results of the measurements are shown in Table 3.

TABLE 3

| | $H_c$ [kA/m] | $M_r$ [mT] | $M_m$ [mT] | $A_T$ [dB] | $A_H$ [dB] |
|---|---|---|---|---|---|
| Example 3 | 83.3 | 318 | 269 | +1 | +1 |
| Comparative Experiment 7 | 78.9 | 304 | 245 | 0 | 0 |

We claim:

1. A process for the manufacture of acicular ferromagnetic iron particles which comprises: coating the surface of acicular particles of iron (III) oxide hydroxide and consisting essentially of goethite with (1) a mixture of an alkaline earth metal compound and a monobasic, dibasic or tribasic aliphatic carboxylic acid of up to 6 carbon atoms, (2) an alkaline earth metal compound and an organic compound which contains two or more groups which can form chelates of the alkaline earth metal cation or (3) an hydrolysis-resistant substance consisting essentially of a phosphorus oxyacid, its ester or its inorganic salt and an aliphatic mono-, di- or tribasic carboxylic acid of 1 to 6 carbon atoms; heating the coated particles at a temperature of from 250° to 450° C. for a period of from 10 minutes to 10 hours in an atmosphere containing water vapor at a partial pressure of from 30 to 1013 mbar; and thereafter heating the particles in the presence of hydrogen at temperatures of from 275° to 425° C. to reduce the particles and thus form acicular ferromagnetic iron particles, whereby the coercivity of the treated particles is higher than the coercivity of the particles prepared by the above process absent said heating of the coated particles in the water vapor containing atmosphere.

2. The process of claim 1, wherein said coated particles are contacted with an inert gas laden with moisture during the heating step whereby an atmosphere containing water vapor at a partial pressure of from 70 to 1013 mbar is maintained.

* * * * *